United States Patent [19]

Busch

[11] Patent Number: 4,922,589

[45] Date of Patent: May 8, 1990

[54] PROCESS AND APPARATUS FOR REPEATEDLY CONTROLLING A FABRIC NAPPING OPERATION

[75] Inventor: Wilhelm Busch, Monchen-Gladbach, Fed. Rep. of Germany

[73] Assignee: Gebruder Sucker & Franz Mueller GmbH & Co., Monchen-Gladbach, Fed. Rep. of Germany

[21] Appl. No.: 249,342

[22] Filed: Sep. 23, 1988

[30] Foreign Application Priority Data

Sep. 23, 1987 [DE] Fed. Rep. of Germany ..... 3731898

[51] Int. Cl.[5] ..... D06C 11/00

[52] U.S. Cl. ..... 26/29 R; 26/33

[58] Field of Search ..... 26/29 R, 33, 34, 35

[56] References Cited

U.S. PATENT DOCUMENTS 2,999,294 9/1961 Magarshack et al. ..... 26/33

3,373,468 3/1968 Mullers ..... 26/29 R

FOREIGN PATENT DOCUMENTS 59-21770 2/1984 Japan ..... 26/34

*Primary Examiner*—Werner H. Schroeder

*Assistant Examiner*—Bradley K. DeSandro

*Attorney, Agent, or Firm*—Shefte, Pinckney & Sawyer

[57] ABSTRACT

The napping operation of a napping machine of the type having a rotating cylinder with a plurality of toothed rotating napping rollers at its periphery for napping engagement with a traveling fabric web is controlled for repeatable napping results by measuring the cyclical pattern of a radially inward deflection of the fabric web under the napping engagement of the rollers as a characteristic of an adjustment of a variable operating parameter which may be later utilized as a reference value for subsequent adjustment of the operating parameter to repeat the results of the napping operation.

7 Claims, 1 Drawing Sheet

FIG. 1
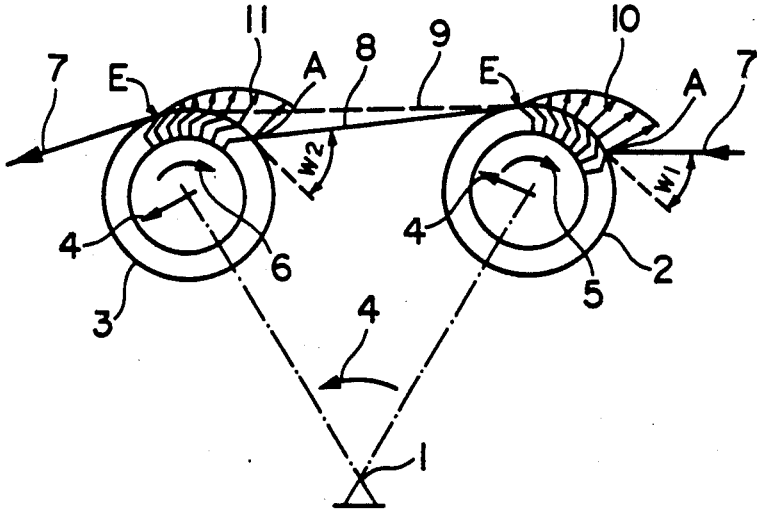
FIG. 2
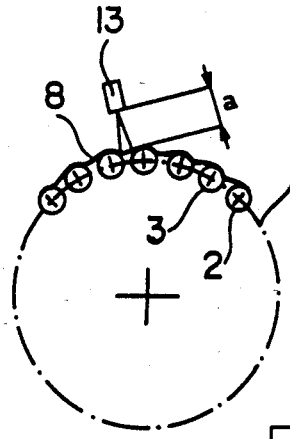
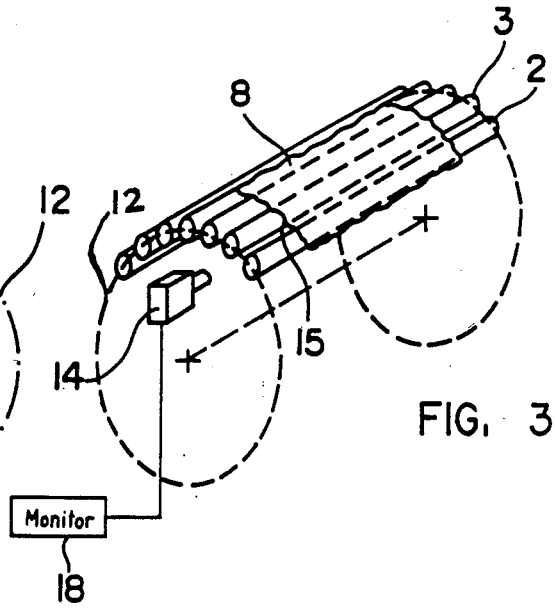
FIG. 3
FIG. 4
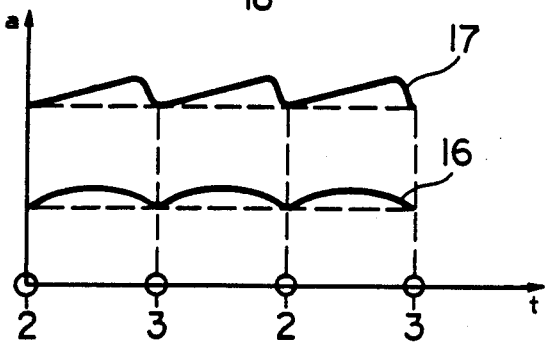

PROCESS AND APPARATUS FOR REPEATEDLY CONTROLLING A FABRIC NAPPING OPERATION

BACKGROUND OF THE INVENTION

The present invention relates broadly to methods and apparatus for napping a traveling fabric web and, more particularly, to a novel method and apparatus by which such napping operations may be repeatably controlled to achieve consistent napping results.

It is known to provide a textile fabric with a raised surface effect by brushing the fabric surface, commonly referred to as napping. A common type of conventional napping machine has a rotating cylinder with a plurality of rotating toothed rollers at the periphery of the cylinder. Typically, card clothing covers the periphery of the rollers. The card teeth may be arranged selectively to project in the same direction as, or counter to, the direction of roller rotation or alternating and intermediate rollers may be provided with oppositely projecting card teeth. In napping operation, a textile fabric web is directed to travel peripherally with respect to the rotating cylinder for napping engagement of the fabric surface by the teeth of the rotating rollers.

The napping effect of cylinder-type napping machines of this type may be varied by adjustment of a number of operating parameters, including the type of card clothing selected for the rotating rollers, the sequence of nap rollers having oppositely projecting card teeth, pretreatment of the fabric web such as by emerizing or chemical treatment, the traveling speed of the fabric web selected, the tension in the fabric web, adjustment of the rotational speed of the rollers, adjustment of the degree of slippage of the napping rollers with respect to their belt drive arrangement, the number of napping passes to which the fabric web is subjected, and lifting devices provided on the periphery of the cylinder. Normally, it is optimally desirable to perform a napping operation with the fabric web traveling at as high a speed as practical and with as few a number of napping passes of the fabric web as necessary to achieve the desired napping effect.

It is, of course, possible to preset or control all of the aforementioned operating parameters of a napping operation in order to provide optimal results. West German Patent No. 11 45 573 discloses a method for controlling various such operating parameters. However, no accepted standards and no known devices exist for precisely measuring the napping effect achieved in any given napping operation. Accordingly, the adjustment of operating parameters in a napping operation generally can be effectively accomplished only by an experienced technician and, even then, uniform napping results are only conditionally reproducible from one napping operation to another.

SUMMARY OF THE INVENTION

It is accordingly an object of the present invention to provide a method and apparatus by which a precise physical measurement may be taken of a given napping effect to provide a basis for controlling the napping operation of a napping machine to enable the napping effect to be subsequently reproducible.

It has been discovered that each adjustment of the aforementioned operating parameters of a napping operation utilizing a napping machine of the rotating cylinder type produces a characteristic radially inward drawing of the traveling fabric web with respect to the cylinder under the peripheral napping engagement of the toothed rollers. This results because the mechanical inter-relationship between the toothed rollers and the traveling fabric web varies as a function of the adjustable operating parameters. As will be understood, napping of the traveling fabric web occurs only along the arcuate extent of the periphery of the rotating toothed rollers which actually contacts the fabric web, the raising of the fabric surface being specifically a result of the entry of the teeth into and withdrawal of the teeth from the body of the fabric. Accordingly, the radially inward drawing of the fabric web with respect to the rotating cylinder plays a crucial roll in the effect of the napping operation in raising the fabric surface.

Therefore, according to the process and apparatus of the present invention, the napping operation of a napping machine of the rotating cylinder type is repeatably controlled by measuring the degree to which the fabric web is drawn radially inwardly of the cylinder under the peripheral napping engagement of the rollers as a characteristic of an adjustment of a variable operating parameter of the napping operation. Then, the measurement may be later utilized as a reference value for subsequent adjustment of the operating parameter for repeating the napping operation. By way of example, the variable operating parameter represented by the measurement taken according to the present invention may be any one of the following: the tension in the fabric web, the traveling speed of the fabric web, the rotational speed of the toothed rollers, and the amount of drive slippage of the rollers. Advantageously, the measurement need be the only reference value utilized for adjustment of all of the operating parameters of the napping operation.

Accordingly, the present invention contemplates that all adjustable operating parameters of the napping operation which affect the results achieved are to monitored simply by measurement of the degree of radially inward drawing of the fabric web. Conversely, the nature of the napping results achieved by the napping operation may be modified simply by regulating this measurement. For example, the measure of the radially inward drawing of the fabric web may be changed or regulated, even during operation of the napping machine, by changing the tension of the fabric web and/or its traveling speed, by selectively changing the rotational speeds of the napping rollers, and/or by adjusting the amount of drive slippage of the napping rollers. If the optimum measurement of the radially inward drawing of the fabric is not achieved by such means, this may indicate that the card clothing has become dull or is otherwise unsuitable for the fabric web being processed. Further changes may be made in the napping operation through pre-selection of the card clothing, pretreatment of the fabric web and other similar steps.

The degree to which the fabric web is drawn radially inwardly with respect to the rotating cylinder may be determined according to the present invention in various manners using various detection instruments. Preferably, the instrumentation utilized is operable without requiring mechanical contact with the traveling fabric web and, as desired, the data obtained by the instrumentation may be fed directly to a means for automatic control of the napping operation. It is further advantageous that the instrumentation permit a visual display of the degree of radially inward drawing of the fabric web so that the effect of an adjustment in one or more of the various operating parameters may be observed and optimized. Further, a visual display allows the maximum permissible degree of radially inward drawing of the fabric web to be monitored, without affecting the results of the napping operation, to avoid undesirable winding of the fabric web about the napping rollers during operation.

In accordance with the foregoing considerations, measurements may be taken according to the present invention utilizing a sensing device arranged out of contact with the fabric web, preferably at a fixed location relative to the periphery of the rotating cylinder (e.g. at a fixed disposition radially outwardly of the cylinder), for detecting displacement of the fabric web from a reference path extending tangentially with respect to the napping rollers. Preferably, the sensor is capable of determining the cycle of such displacement of the fabric web between successive rollers in relation to the increment in operating time required for each displacement cycle. Ultrasonic sensing devices, devices adapted for reflecting light off the fabric web, or devices for stroboscopic illumination of the fabric web are particularly suitable for use as displacement sensors for the foregoing purpose. Alternatively, the pattern or cycle in which the traveling fabric web is radially inwardly drawn or displaced with respect to the periphery of the rotating cylinder may also be detected photographically and displayed on a monitor by a suitable camera directed from a fixed disposition at a lateral edge of the fabric web on the periphery of the rotating cylinder. In all cases, a stationary pattern of the cyclical displacement of the fabric web may be displayed on a screen by synchronizing the detector with the frequency with which the successive napping rollers pass by the detector.

BRIEF DESCRIPTION OF THE DRAWINGS

FIG. 1 is a schematic side elevational view of a napping machine of the rotating cylinder type, representatively illustrating the effect of two successive napping rollers in drawing a fabric web radially inwardly with respect to the cylinder;

FIG. 2 schematically illustrates in side elevation an embodiment of the present invention utilizing a displacement sensor arranged at a radial spacing from the periphery of the rotating cylinder;

FIG. 3 is schematic perspective view illustrating an embodiment of the present invention utilizing a camera directed at a lateral edge of a fabric web on the periphery of the rotating cylinder; and FIG. 4 is a graph depicting the cycle of displacement of a fabric web between successive napping rollers on the rotating cylinder in relation to operating time of the napping machine.

DESCRIPTION OF THE PREFERRED EMBODIMENT

Referring now to the accompanying drawings, FIG. 1 schematically illustrates in side elevation the napping operation of a napping machine of the type having a cylinder which rotates about an axis 1 and which has a plurality of rotating napping rollers arranged axially about the periphery of the cylinder, only two successive napping rollers 2,3 being shown for simplicity of illustration. A web of textile fabric 8 is directed to travel in open width contact with the periphery of the rotating cylinder in a direction indicated by the arrows 7, the cylinder being rotated so that its peripheral surface and its napping rollers 2,3 move in essentially the same direction as the fabric web 8, as indicated by the directional arrows 4. The napping rollers 2,3, however, are rotated in the opposite direction, as indicated by directional arrows 5,6, so that their respective peripheries move in a direction opposite to the fabric web 8. The periphery of each of the napping rollers 2,3 is covered by a plurality of angular wire teeth, e.g. card clothing, the napping roller 2 having its teeth extending angularly in the direction of travel of the fabric web 8 (i.e. opposite the roller's own rotational direction) and the napping roller 3 having its teeth extending angularly opposite to the direction of travel of the fabric web 8 (i.e. in the same direction as the roller's own rotation).

As illustrated, the fabric web 8 does not follow a tangential path of travel with respect to the napping rollers 2,3, as indicated by the broken line 9, but instead the action of the teeth of the napping rollers 2,3 in engaging the facing surface of the traveling fabric web 8, as indicated by the lines of force 10,11, maintains engagement with the traveling web 8 over an effective arcuate extent of each roller 2,3 between points A and E, which as will be appreciated is a considerably greater area of effective fabric engagement than achieved by travel of the fabric web 8 in a tangential path 9. As a result, as the fabric web 8 travels from the point E at which it leaves engagement with one napping roller (e.g. roller 2) to the point A at which the web 8 first engages the next succeeding napping roller (e.g. roller 3), the fabric web 8 is progressively drawn radially inwardly with respect to the rotating cylinder, i.e., the web 8 is progressively displaced radially inwardly from the tangential path 9. By way of example and for purposes of illustration only, the measures of the degree of radially inward drawing of the fabric web 8 by the napping rollers 2,3 are indicated, respectively, by the angles W1 and W2.

As aforementioned, the degree of radially inward drawing or displacement of the fabric web is uniquely characteristic of the particular settings of the adjustable operating parameters of a napping machine for any given napping operation. Accordingly, the present invention contemplates the measurement of the radial displacement of the fabric web resulting from the peripheral napping engagement of the rollers for use as a reference value by which adjustment of one or more operating parameters of the napping operation may later be precisely controlled to enable the napping operation to be reliably repeated. More specifically, the measurement obtained by the present invention should represent the cycle of fabric web displacement, i.e., the amount of progressive increase in radially inward web displacement from one napping roller to the next succeeding napping roller in relation to the incremental operating time required for fabric travel between the successive rollers.

FIG. 2 illustrates one embodiment of the present invention wherein a deflection sensing device 13 is mounted at a fixed location radially outwardly from the periphery of a napping machine of the rotating cylinder type provided with a plurality of napping rollers 2,3 mounted at the cylinder periphery. The sensor 13 may be of any suitable conventional type of device capable of detecting and measuring the distance a radially between the sensor 13 and the lengthwise traveling extent of the fabric web 8 at a point along the arcuate extent of the fabric's contact with the cylinder, thereby to determine the deflection pattern of the fabric web 8 as the web travels over the rotating cylinder. For this purpose, the sensor 13 may be an ultrasonic sensor of a type adapted to reflect ultrasonic sound waves off the surface of the fabric web 8 facing radially outwardly of the cylinder 12 to measure the distance a. Alternatively, the sensor 13 may similarly be of a conventional type adapted to reflect light waves off the outward surface of the fabric web. As a still further possibility, the sensor 13 may be a stroboscope for intermittent illumination of the outward surface of the fabric web 8 to provide for visual detection of the degree of radially inward fabric deflection. Of course, those persons skilled in the art will readily recognize that other detection devices may be of equal utility for measuring the fabric web deflection pattern. In each case, the sensor 13 is advantageously out of physical contact with the traveling fabric web and the napping machine.

As will be understood, the distance a changes in a repeating pattern as a result of the rotation of the napping cylinder. By means of the sensor 13 of FIG. 2, the cyclical pattern of progressive fabric web displacement between successive napping rollers 2,3 may be determined by plotting the measurements taken of the distance a against the time interval of the measurements, as represented by the line 17 of FIG. 4, and the displacement cycle thusly determined may be recorded, as desired, and stored in a central computer. More specifically, the saw-tooth wave line 17 of FIG. 4 represents the progressive degree of radially inward displacement of the fabric web 8 from the point at which it leaves contact with one napping roller (e.g. point E in FIG. 1) to the point at which it first contacts the next successive napping roller (e.g. point A in FIG. 1) as related to the operational time interval required for the fabric web 8 to travel such distance, as more fully explained with respect to FIG. 1 above, this saw-tooth pattern of progressive web displacement being the result of the napping energy imparted by rotation of the individual napping rollers 2,3 simultaneously with the rotation of their supporting cylinder. In contrast, the line 16 represents the generally symmetrical degree of increasing and decreasing fabric web deflection which would result if the individual napping rollers were not rotated, whereby the napping rollers would not themselves impart any napping energy to the fabric web. The curve 16 is shown to be symmetrical for sake of simplicity, it being recognized that the differing web deflection angles W1,W2 created by the oppositely oriented teeth of the napping rollers 2,3 would actually cause the deflection pattern to be somewhat asymmetrical.

FIG. 3 illustrates an alternate embodiment of the present invention wherein a camera 14 is mounted in a fixed disposition at an axial spacing from the periphery of a rotating napping cylinder 12 having a plurality of peripheral napping rollers 2,3, with the camera 14 being directed toward the facing lengthwise lateral edge 15 of a fabric web 8 traveling along the cylinder periphery. In this manner, the camera 14 is enabled to photograph the radially inward deflection of the fabric web 8 between successive napping rollers 2,3 and, by triggering the photographic operation of the camera 14 in synchronism with the frequency of movement of the napping rollers 2,3 past the camera 14, a stationary representation of the cycle of web displacement in relation to operating time, such as the cycle line 17 of FIG. 4, may be displayed on an associated monitor or like display screen.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments adaptations, variations, modifications and equivalent arrangements, the present invention being limited only by the claims appended hereto and the equivalents thereof.

I claim:

1. A process for repeatably controlling a napping operation by a napping machine of the type having a rotating cylinder having a plurality of rotating toothed rollers at the periphery of said cylinder for successive peripheral napping engagement with a traveling fabric web, said process comprising measuring the angular degree to which said fabric web is drawn radially inwardly of said cylinder from a path tangential to said rollers under said peripheral napping engagement of said rollers during travel of said fabric web from a point of disengagement with one said roller to a point of initial engagement with the next succeeding roller in relation to the operational time interval required for travel of said fabric web between said points as a characteristic of an adjustment of a variable operating parameter of said napping operation and utilizing the measurement as a reference value for subsequent adjustment of said operating parameter for repeating said napping operation.

2. A process for repeatably controlling a napping operation according to claim 1 and characterized further by utilizing the measurement as the only reference value for adjustment of all operating parameters of said napping operation.

3. A process for repeatably controlling a napping operation according to claim 1 and characterized further in that said variable operating parameter represented by the measurement is one of the tension in the fabric web, the traveling speed of the fabric web, the rotational speed of said rollers, and the amount of drive slippage of said rollers.

4. A process for repeatably controlling a napping operation according to claim 1 and characterized further in that said measuring compromises ultrasonically detecting displacement of said fabric web from a reference path extending tangentially with respect to said rollers.

5. A process for repeatably controlling a napping operation according to claim 1 and characterized further in that said measuring comprises reflecting light off said fabric web for detecting displacement of said fabric web from a reference path extending tangentially with respect to said rollers.

6. A process for repeatably controlling a napping operation according to claim 1 and characterized further in that said measuring comprises visually determining radially inward drawing of said fabric web by stroboscopic illumination of the side of said fabric web opposite said rollers.

7. A process for repeatably controlling a napping operation according to claim 1 and characterized further in that said measuring comprises photographing radially inward drawing of said fabric web by a camera directed at a lateral edge of said fabric web and displaying a representation of radially inward drawing of said lateral edge on a monitor.

* * * * *